US009378913B2

(12) United States Patent
Sato et al.

(10) Patent No.: US 9,378,913 B2
(45) Date of Patent: Jun. 28, 2016

(54) OPERATING DEVICE OR VACUUM SWITCH

(71) Applicant: Hitachi, Ltd., Chiyoda-ku, Tokyo (JP)

(72) Inventors: Takashi Sato, Tokyo (JP); Ayumu Morita, Tokyo (JP); Kenji Tsuchiya, Tokyo (JP); Masato Yabu, Tokyo (JP); Akio Nakazawa, Tokyo (JP); Hisao Kawakami, Tokyo (JP); Shigeru Yokosuka, Tokyo (JP); Seiji Seya, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 14/408,714

(22) PCT Filed: Jun. 3, 2013

(86) PCT No.: PCT/JP2013/065314

§ 371 (c)(1),
(2) Date: Dec. 17, 2014

(87) PCT Pub. No.: WO2013/190983

PCT Pub. Date: Dec. 27, 2013

(65) Prior Publication Data

US 2015/0318132 A1 Nov. 5, 2015

(30) Foreign Application Priority Data

Jun. 18, 2012 (JP) ..... 2012-136497

(51) Int. Cl.
*H01H 50/02* (2006.01)
*H01H 50/04* (2006.01)
(Continued)

(52) U.S. Cl.
CPC ..... *H01H 50/021* (2013.01); *H01H 33/38* (2013.01); *H01H 33/6662* (2013.01);
(Continued)

(58) Field of Classification Search
CPC ..... H01H 33/6662; H01H 50/64; H01H 2003/266; H01H 33/38
See application file for complete search history.

(56) References Cited

U.S. PATENT DOCUMENTS 6,689,968 B2 * 2/2004 Trivette ..... H01H 33/666 200/50.21
6,852,939 B2 * 2/2005 Rhein ..... H01H 33/6662 218/120

(Continued)

FOREIGN PATENT DOCUMENTS

CN 1725407 A 1/2006
CN 201556538 U 8/2010

(Continued)

OTHER PUBLICATIONS

International Search Report dated Jul. 9, 2013 with English translation (three (3) pages).

(Continued)

*Primary Examiner* — Truc Nguyen
(74) *Attorney, Agent, or Firm* — Crowell & Moring LLP

(57) ABSTRACT

The invention has an object to provide an operating device or vacuum switch which permits reduction in the overall height of the operating device and improves installation convenience. In order to solve the above problem, an operating device according to the present invention is characterized by including an electromagnet 14 located in a case 10 and fixed to the case 10 through a fixing part, a capacitor 16 located at an end in the case 10, a control board 18 located opposite to the capacitor 16 across the electromagnet 14, an auxiliary contact 34 located above the capacitor 16, a movable part to move by a magnetic force generated from the electromagnet 14, and a power transmission section to operate in conjunction with movement of the movable part. The capacitor 16 and the auxiliary contact 34 are located at heights not exceeding the height of the fixing part for fixing the electromagnet 14.

20 Claims, 4 Drawing Sheets

(51) Int. Cl.

| | |
|---|---|
| ***H01H 50/60*** | (2006.01) |
| ***H01H 50/64*** | (2006.01) |
| ***H01H 33/38*** | (2006.01) |
| ***H01H 33/666*** | (2006.01) |

(52) U.S. Cl.

CPC ..... *H01H 50/04* (2013.01); *H01H 50/60* (2013.01); *H01H 50/64* (2013.01); *H01H 2033/6667* (2013.01); *H01H 2205/002* (2013.01)

(56) References Cited

U.S. PATENT DOCUMENTS

| | | | | |
|---|---|---|---|---|
| 8,570,121 | B2 * | 10/2013 | Sawada | H01H 3/28 335/220 |
| 2001/0017288 | A1 | 8/2001 | Morita et al. | |
| 2003/0184945 | A1 * | 10/2003 | Trivette | H01H 33/666 361/139 |
| 2004/0144757 | A1 * | 7/2004 | Rhein | H01H 33/6662 218/120 |
| 2006/0028073 | A1 * | 2/2006 | Sugino | H01H 33/022 310/12.18 |
| 2008/0156775 | A1 * | 7/2008 | Morita | H01H 33/6662 218/140 |

FOREIGN PATENT DOCUMENTS

| | | | |
|---|---|---|---|
| EP | 1 416 503 | A2 | 5/2004 |
| JP | 2001-237118 | A | 8/2001 |
| JP | 2004-152625 | A | 5/2004 |
| JP | 2005-268037 | A | 9/2005 |

OTHER PUBLICATIONS

Chinese-language Office Action issued in counterpart Chinese Application No. 201380031237.X dated Jan. 5, 2016 (Six (6) pages).

European Search Report issued in counterpart European Patent Application No. 13806077.7 dated Feb. 1, 2016 (nine pages).

"VM1 Installation and service instructions", ABB AG—Calor Emag Medium Voltage Products, Nov. 17, 2010, 54 pages, XP-002752883.

* cited by examiner

OPERATING DEVICE OR VACUUM SWITCH

TECHNICAL FIELD

The present invention relates to an operating device or vacuum switch which is used in a switching apparatus for power reception and distribution and more particularly to an operating device which generates an operating force using an electromagnet or a vacuum switch in which the operating device is mounted.

BACKGROUND ART

One example of a conventional vacuum switch is described in Patent Literature. Patent Literature 1 describes an operating device in which an electromagnet is located in the central lower part of a case, a capacitor and a control board are located on the both sides of the electromagnet in the case, and an auxiliary contact, a display plate, a counter are located above the electromagnet, and the auxiliary contact, display plate and counter are fitted to a plate and integrated with the electromagnet, and a vacuum switch which performs operation to make or break the circuit using the operating device.

CITATION LIST

Patent Literature

Patent Literature 1: Japanese Patent Application Laid-Open No. 2004-152625

SUMMARY OF INVENTION

Technical Problem

However, the conventional vacuum switch has a drawback that the height of the operating device is large because the auxiliary contact and so on are located above the electromagnet and fitted to the plate and integrated with the electromagnet.

Therefore, the present invention has an object to provide an operating device or vacuum switch which permits reduction in the overall height of the operating device and improves installation convenience.

Solution to Problem

In order to solve the above problem, an operating device according to the present invention is characterized by including an electromagnet located in a case and fixed to the case through a fixing part, a capacitor located at an end in the case, a control board located opposite to the capacitor across the electromagnet, an auxiliary contact located above the capacitor, a movable part to move by a magnetic force generated from the electromagnet, and a power transmission section to operate in conjunction with movement of the movable part, in which the capacitor and the auxiliary contact are located at heights not exceeding the height of the fixing part for fixing the electromagnet.

Furthermore, a vacuum switch according to the present invention is characterized by including the operating device, a movable electrode operated through movement of the movable part, a fixed electrode located opposite to the movable electrode, a vacuum container housing the movable electrode and the fixed electrode, and a bus or cable connected to either the movable electrode or the fixed electrode through a conductor.

Advantageous Effects of Invention

According to the present invention, the overall height of the operating device is reduced to improve installation convenience.

DESCRIPTION OF EMBODIMENTS

Next, a preferable embodiment of the present invention will be described referring to drawings. The embodiment described below is just an example and not intended to limit the mode of the invention to the specific mode described below. Regardless of the embodiment, the invention may be embodied in various modified modes.

Embodiment

The embodiment will be described referring to FIGS. 1 to 4.

Figure 1:
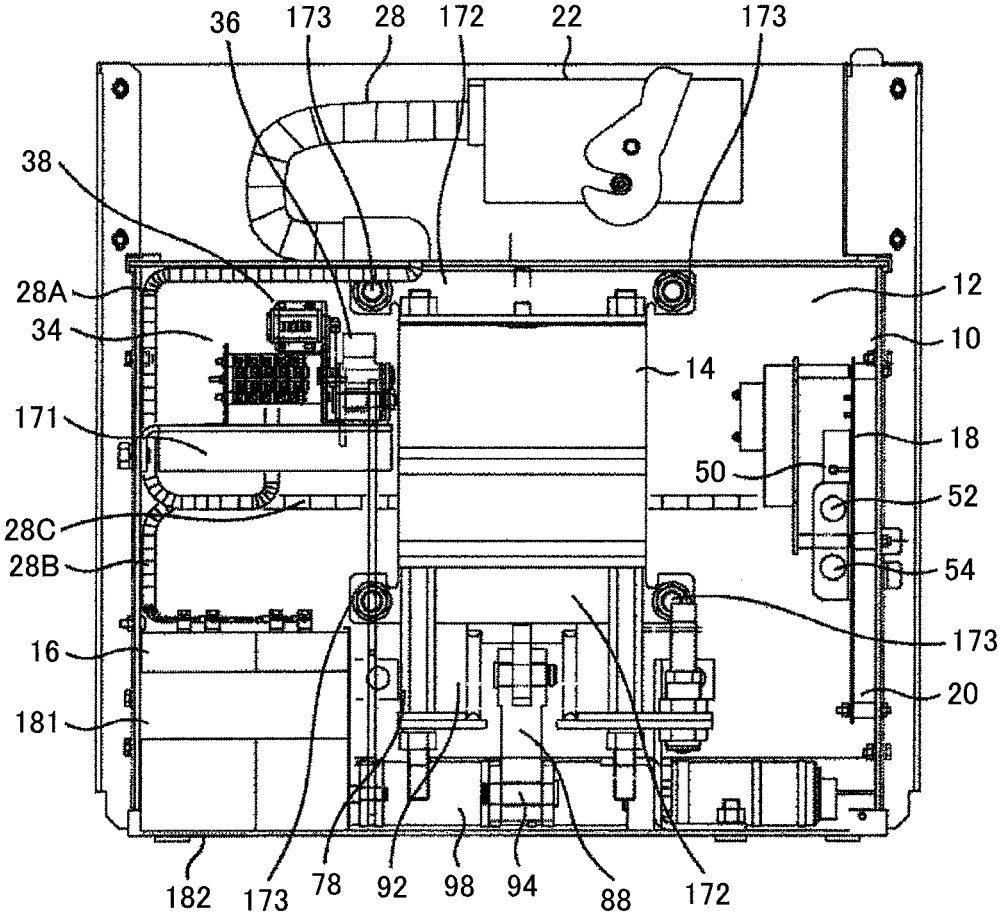
FIG. 1 is a front sectional view of a vacuum switch in an embodiment.

A shown in FIG. 1, an operating device according to this embodiment includes a box-shaped case 10 and the case 10 has an opening 12 on the front side and a front cover (not shown in the figure) is fixed to the front side of the case 10 in an attachable and detachable manner. Inside the case 10, a capacitor 16 is located on one end side of an electromagnet 14 located in the center of the case 10 and a control board 18 is located opposite to the capacitor with the electromagnet 14 between them. The electromagnet 14 is fixed to the front of the case 10 through a rib 172 with bolts 173 and nuts. Since the electromagnet 14 is fixed to a front of the case 10, installation workability is improved. The capacitor 16 and control board 18 are fixed to the lateral sides of the case 10, facing each other. Specifically, the capacitor 16 is fixed by fixing a lateral side of the capacitor 16 fixed to a belt 181 as a supporting member on the left lateral surface of the case 10 in FIG. 1 and fixing the belt 181 itself, to which the capacitor 16 is fixed, to the case with fixing means such as bolts and nuts. The control board 18 is fixed to the case on the right lateral surface of the case 10 in FIG. 1 through a spacer 20 with fixing means such as bolts and nuts. The bottom of the case 10 is covered by a bottom plate 182.

Figure 3:
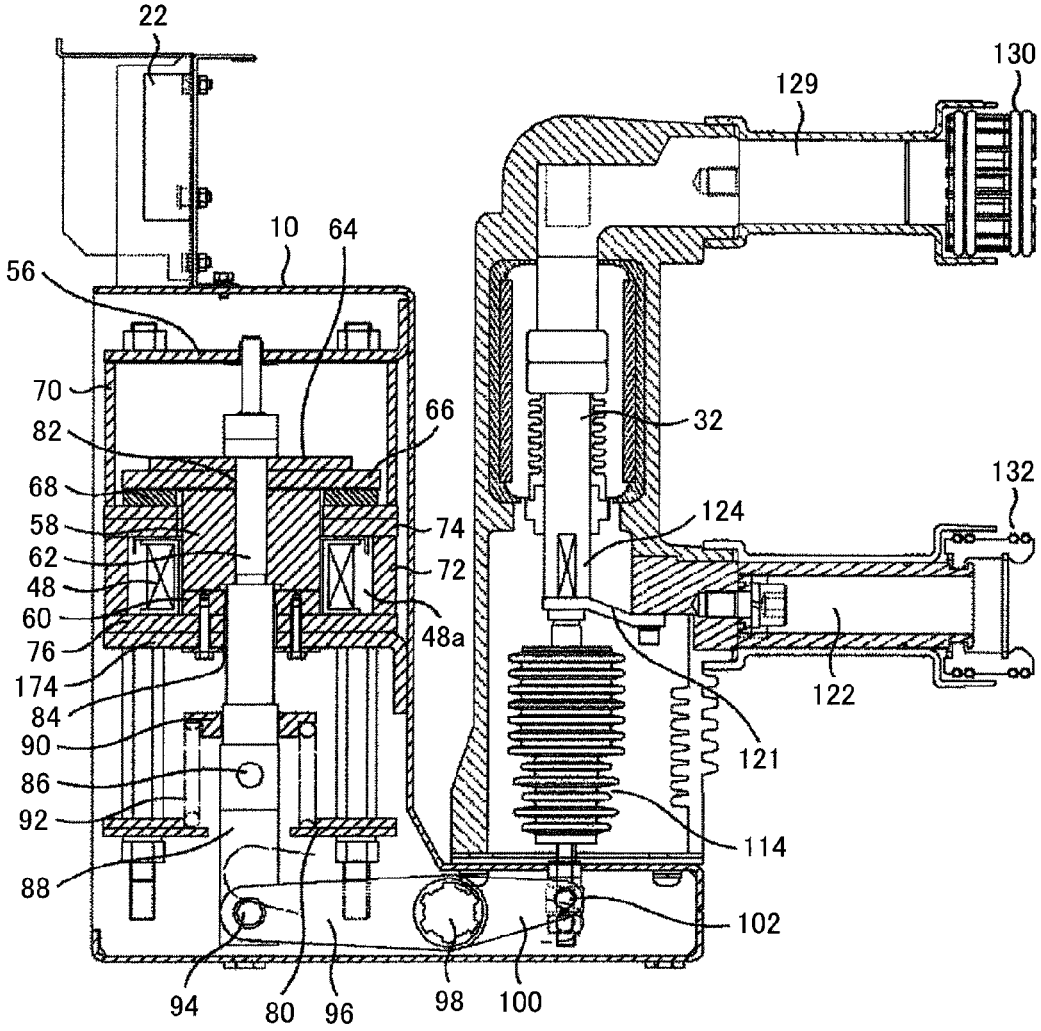
FIG. 3 is a right side view of the vacuum switch in the embodiment.

As shown in FIG. 3, the electromagnet 14 includes a shaft 62 passing through vertically in the centers of a support plate 174 and a support plate 76, a fixed core 60 held above the support plate 174 and support plate 76 and located around the shaft 62, a movable core 58 connected to the shaft 62 above the fixed core 60, a coil 48 located on the peripheral sides of the movable core 58 and fixed core 60, two movable flat plates 64 and 66 located above the movable core 58 and fixed to the movable core 58, a support plate 74 located above the coil 48 on the peripheral side of the movable core 58, a permanent magnet 68 located between the support plate 74 and the movable flat plate 66, a cover 70 connected to the support plate 74, covering the upper outside of the electromagnet 14, and a plate 56 connected to the cover 70 to serve as a top cover of the electromagnet 14. The coil 48 is housed in a coil bobbin

48*a* placed between the support plate 74 and the support plate 76. The shaft 62 is connected to a shaft 88 through a pin 86 below the support plate 174. The shaft 62 is located in the center of the electromagnet 14 along the vertical direction. The upper portion of the shaft 62 is inserted into a through hole 82 in the movable flat plate 66 and its lower portion is inserted into a through hole 84 in the support plate 76 so that the shaft freely moves up and down and slide. The movable core 58 and movable flat plates 64 and 66 are fixed to the peripheral surface of the shaft 62 with nuts and the lower portion of the shaft 62 is coupled to the shaft 88 through the pin 86. The two large and small movable flat plates 64 and 66 are fitted to the shaft 62 in order to increase the distance between the upper movable flat plate 64 and the iron cover 70 to reduce flux leakage to the iron cover 70. A support plate 90 is coupled to the lower portion of the shaft 62 and a ring-shaped trip spring 92 forming a circle centered at the shaft center of the shaft 62 is attached between the support plate 90 and a base 80. This trip spring 92 is designed to give the shaft 62 an elastic force to move the movable core 58 away from the fixed core 60 through the support plate 90. The permanent magnet 68 is located around the movable core 58 and the permanent magnet 68 is fixed to the mounting plate 74. The support plate 90 is connected to one end of the trip spring 92 and the other end of the trip spring 92 is connected to the base 80. The support plate 90 moves together with the shaft, thereby enabling the trip spring 90 to expand and shrink to store or release the elastic energy. The lower portion of the shaft 88 is coupled to a pair of levers 96 through a pin 94. The levers 96 are structured as an element of a power transmission section which performs the function of transmitting the driving force entailed by the electromagnetic force generated from the electromagnet 14 to a movable electrode, and coupled to a lever 100 through a shaft 98. The lever 100 is coupled to an insulating rod 114 through a pin 102.

A wipe mechanism which gives contact pressure is built in the insulating rod 114 and the upper portion of the insulating rod 114 is coupled to a movable feeder 122 through a flexible conductor 121 and also coupled to a movable conductor 124 of a vacuum circuit-breaking part 32. The movable conductor 124 is coupled to the movable electrode and a fixed electrode is located opposite to the movable electrode. The fixed electrode is coupled to a fixed conductor. These are housed in an insulating cylinder which constitutes the vacuum circuit-breaking part 32, together with the movable electrode. The inside of the insulating cylinder is kept vacuum. The fixed conductor is coupled to a fixed feeder 129, the fixed feeder 129 is coupled to an upper contactor 130, the movable feeder 122 is coupled to a lower contactor 132, and the contactors 130 and 132 are to be connected to a power cable such as a service wire or a bus.

As shown in FIGS. 1 and 3, a secondary plug 22 is fixed above the case 10 with bolts and nuts and the secondary plug 22 is to be connected to cables 28A, 28B, and 28C including a power cable and a signal cable from a digital relay or analog relay. The cables 28A, 28B, and 28C are connected to an auxiliary contact 34 and the control board 18. Specifically, the cable 28A is connected to the auxiliary contact 34 in a way to keep away from and bypass the auxiliary contact 34, display plate 36, and counter 38. The cable 28B is connected to the cable 28A and connected to the capacitor 16. The cable 28C is connected to the cables 28A and 28B and connected to the control board 18.

Mounted on the control board 18 are a control logic section which is supplied with power from the secondary plug 22 and receives a circuit making command or open command (circuit breaking command) from the digital relay or analog relay and performs logical operation to control the drive of the electromagnet 14, a charge/discharge circuit for charging or discharging the capacitor 16, and a relay and relay contact for controlling the direction of energization of the coil 48. Furthermore, mounted on the control board 18 are a light emitting diode 50 to show completion of charge of the capacitor 16 and also an "ON" pushbutton switch 52 to give a circuit making command to the vacuum circuit-breaking part 32 by manual operation, and an "OFF" pushbutton switch 54 to give an open command (circuit breaking command) to the vacuum circuit-breaking part 32 by manual operation.

Figure 4:
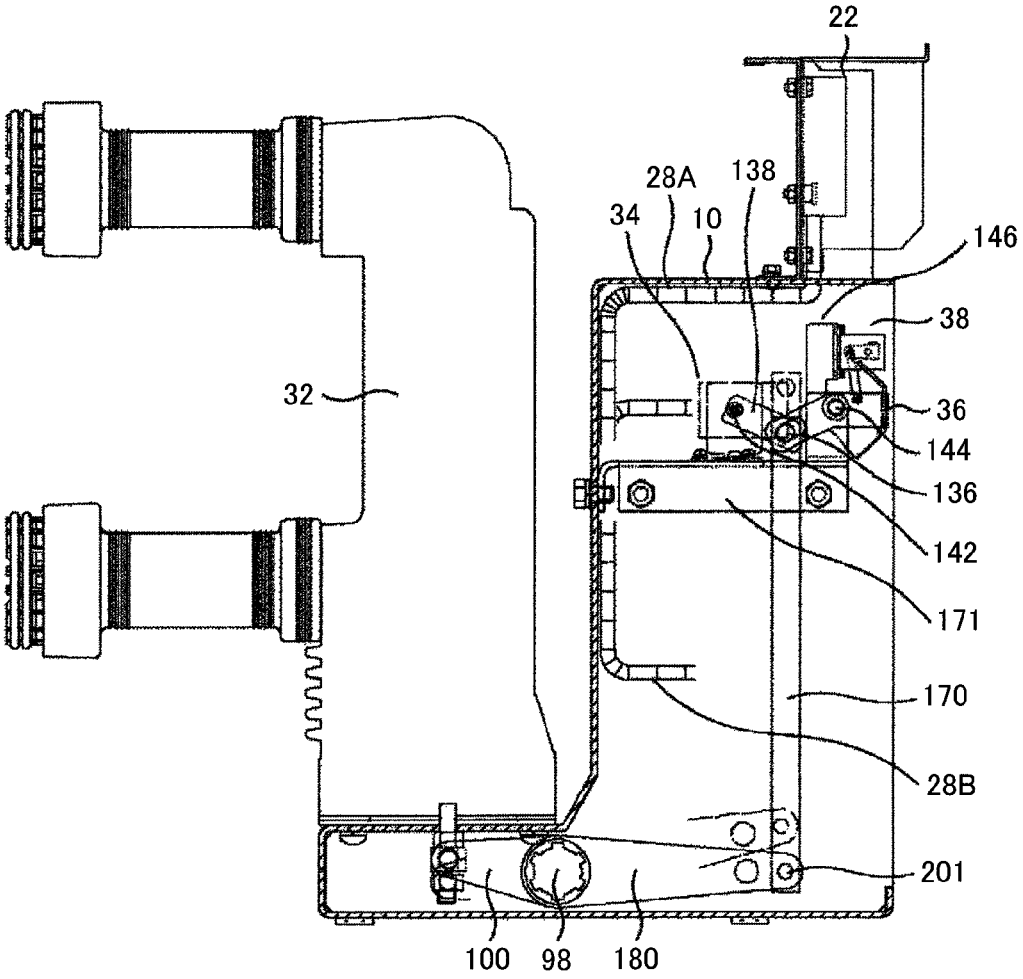
FIG. 4 is a left side view of the vacuum switch in the embodiment.

As shown in FIG. 4, a lever 180 is connected to the shaft 98 and the lever 180 is connected to a rod 170 through a pin 201. The rod 170 is connected to the display plate 36 and a lever 138 through a pin 136. The display plate switches its display according to movement of the rod 170 through the pin 136 to show whether the movable electrode is in a closed or open state with respect to the fixed electrode. The display plate 36 is coupled to the counter 38 and the counter 38 counts the number of movements of the display plate 36. The number of movements of the display plate 36 coincides with the number of movements of the shaft 98 and the number of movements of the shaft 98 coincides with the number of movements of the movable electrode; thus, by counting the number of movements of the display plate 36, how many times the movable electrode enters the closed or open state with respect to the fixed electrode, namely the number of circuit making/breaking operations, can be known and the necessity for maintenance/replacement can be known. The lever 138 is connected to the auxiliary contact 34 by a shaft 142. The auxiliary contact 34 sends the open/closed state of the vacuum circuit-breaking part 32 (whether the movable electrode in the vacuum circuit-breaking part 32 is in the open state or closed state with respect to the fixed electrode) to the outside. The auxiliary contact 34, display plate 36, and counter 38 function as a section for detecting the open/closed state and the number of opening/closing times of the vacuum circuit-breaking part 32 and are supported on the plate 171 which is located above the capacitor 16 and serves as a support plate. A space having a length larger than the distance from the bottom plate 182 to the upper end of the belt 181 is formed between the capacitor 16 and the plate 171 and the capacitor 16 on the front side can be attached or detached just by loosening the belt 181, so workability can be improved. In this embodiment, a space having a length larger than the distance from the bottom plate 182 to the highest position of the belt 181 is formed between the capacitor 16 and the plate 171. However, a space larger than the height of the capacitor 16 may be formed between the capacitor 16 and the plate 171. By doing so, the capacitor 16 in the back can be removed without removing the capacitor 16 on the front side.

In addition, the capacitor 16 is not placed on the bottom plate 182 but fixed to the lateral surface of the case so that the impact directly exerted on the case bottom during operation of the electromagnet is not transmitted to the capacitor 16 and the capacitor is protected from the impact.

Figure 2:
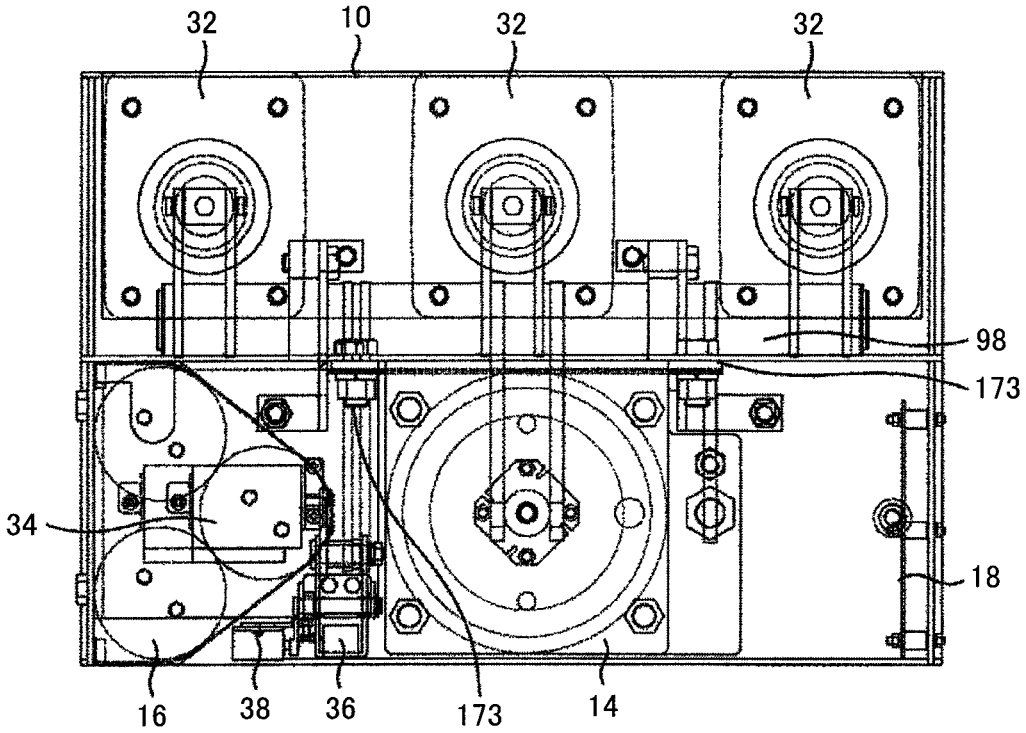
FIG. 2 is a bottom plan view of the vacuum switch in the embodiment.

FIG. 2 is a view as seen from the bottom (lever 96 side) of the vacuum switch according to this embodiment and as shown in the figure, three capacitors 16 are provided and all arranged side by side in a horizontal direction. The three circular-sectional capacitors 16 with the same radius are adjacent to each other, forming a regular triangle. In this embodiment, the three capacitors 16 are combined to provide a prescribed capacitance. In this embodiment thus structured, the space required for the capacitors is larger than when a single capacitor is used to provide the prescribed capacitance, but the capacitors 16 may be smaller in height, so sufficient space is available above the capacitors 16, leading to improvement in workability, and reliability as explained below.

In this embodiment, as shown in FIG. 1, the plate 171 partitions the area between the auxiliary contact 34, display plate 36 and counter 38, and the capacitors 16. By partitioning the area in this way, even if a problem occurs in a capacitor 16 and the electrolyte should blow out of the capacitor, the plate 171 blocks off the electrolyte and prevents contamination of the auxiliary contact 34 and maintains the reliability of the auxiliary contact 34.

In this embodiment, as shown in FIG. 4, the lever 138 of the auxiliary contact 34 and the lever part of the display plate 36 which rotates around a pin 144 are engaged with the operating rod 170 and the operating rod 170 is engaged with the lever 180 by the pin 201. In other words, according to this embodiment, the vacuum circuit-breaking part 32 and the auxiliary contact 34 are connected through four members, namely the lever 100, shaft 98, lever 180, and operating rod 170 and as compared with the vacuum circuit breaker described in Patent Literature 1 in which the vacuum circuit-breaking part 32 and auxiliary contact 34 are connected through a larger number of levers and shafts, they are connected through a smaller number of members, leading to higher reliability.

Furthermore, if a disengagement occurs in the power transmission section from the electromagnet 14 to the shaft 98, when the display plate or auxiliary contact is to change its display according to operation of the electromagnet 14, it might indicate, to the outside, a state different from the actual electrode state, which might create a hazard for the worker. By contrast, according to this embodiment, the state is indicated according to the rotation of the shaft 98 by the operating force of the electromagnet 14, so higher reliability is ensured.

In this embodiment, the electromagnet 14 is almost in the center of the case 10 and the capacitor 16 and the control board 18 are fixed to the lateral surfaces of the case 10 separately so that installation work and maintenance/inspection can be carried out easily and workability can be improved and also transmission of impact and vibration generated from the electromagnet 14 to the capacitor 16 and the control board 18 can be suppressed.

In addition, the capacitor 16 is divided into a plurality of capacitors which are arranged side by side in the horizontal direction to reduce the height and the auxiliary contact 34 and so on are located in the space above the capacitor 16 which is produced by reduction of the height, so efficient space layout can be achieved to reduce the height of the case 10. A single capacitor may be used instead of the plurality of capacitors 16, as long as it is such a capacitor that reduces the height. If the capacitor 16 and the auxiliary contact 34 are arranged at heights not exceeding the height of the fixing part for fixing the electromagnet 14, the height of the operating device can be reduced.

REFERENCE SIGNS LIST

10 . . . case
12 . . . opening
14 . . . electromagnet
16 . . . capacitor
18 . . . control board
20 . . . spacer
22 . . . secondary plug
28A, 28B, 28C . . . cable
32 . . . vacuum circuit-breaking part
34 . . . auxiliary contact
36 . . . display plate
38 . . . counter
48 . . . coil
48*a* . . . coil bobbin
50 . . . light emitting diode
52 . . . ON pushbutton switch
54 . . . OFF pushbutton switch
56 . . . plate
58 . . . movable core
60 . . . fixed core
62, 88, 98 . . . shaft
64, 66 . . . movable flat plate
68 . . . permanent magnet
70, 72 . . . cover
76, 90, 174 . . . support plate
80 . . . base
82, 84 . . . through hole
86, 94, 136, 144, 201 . . . pin
92 . . . trip spring
96, 100, 138, 180 . . . lever
114 . . . insulating rod
122 . . . movable feeder
124 . . . movable conductor
129 . . . fixed feeder
130 . . . upper contactor
132 . . . lower contactor
142 . . . shaft
146 . . . fixing plate
170 . . . rod
171 . . . plate
172 . . . rib
173 . . . bolt
181 . . . belt
182 . . . bottom plate

The invention claimed is:

1. An operating device comprising:
an electromagnet located in a case and fixed to the case through a fixing part;
a capacitor located at an end in the case;
a control board located opposite to the capacitor across the electromagnet;
an auxiliary contact located above the capacitor;
a movable part to move by a magnetic force generated from the electromagnet; and
a power transmission section to operate in conjunction with movement of the movable part, wherein
the capacitor and the auxiliary contact are located at heights not exceeding height of the fixing part for fixing the electromagnet.

2. The operating device according to claim 1, wherein
the capacitor includes a plurality of capacitors, all the capacitors are arranged side by side in a horizontal direction, a movable electrode is operated through movement of the movable part so that switching to an open state or a closed state with respect to a fixed electrode is performed.

3. The operating device according to claim 2, wherein
the number of capacitors is three.

4. The operating device according to claim 1, wherein
the power transmission section includes a shaft to move through movement of the movable part and the movable electrode is moved according to movement of the shaft;
another power transmission section is connected to the shaft;
a rod is connected to the other power transmission section and the rod is moved according to movement of the shaft through the other power transmission section; and
a display plate which changes display according to movement of the rod is provided and the display plate indicates whether the movable electrode is in a closed state or an open state with respect to the fixed electrode.

5. The operating device according to claim 1, wherein the auxiliary contact is supported by a support plate; and an area between the capacitor and the auxiliary contact is partitioned by the support plate.

6. The operating device according to claim 5, wherein a lateral surface of the capacitor is fixed to a supporting member and the supporting member is supported by the case;

a bottom plate is provided on a bottom of the case; and a space larger than distance from the bottom plate to an upper end of the supporting member is formed between the capacitor and the support plate.

7. The operating device according to claim 5, wherein a lateral surface of the capacitor is fixed to a supporting member and the supporting member is supported by the case; and a space larger than height of the capacitor is formed between an upper end of the capacitor and the support plate.

8. A vacuum switch comprising:

the operating device according to claim 1;

a movable electrode operated through movement of the movable part;

a fixed electrode located opposite to the movable electrode;

a vacuum container housing the movable electrode and the fixed electrode; and a bus or cable connected to either the movable electrode or the fixed electrode through a conductor.

9. The operating device according to claim 2, wherein the power transmission section includes a shaft to move through movement of the movable part and the movable electrode is moved according to movement of the shaft;

another power transmission section is connected to the shaft;

a rod is connected to the other power transmission section and the rod is moved according to movement of the shaft through the other power transmission section; and a display plate which changes display according to movement of the rod is provided and the display plate indicates whether the movable electrode is in a closed state or an open state with respect to the fixed electrode.

10. The operating device according to claim 3, wherein the power transmission section includes a shaft to move through movement of the movable part and the movable electrode is moved according to movement of the shaft;

another power transmission section is connected to the shaft;

a rod is connected to the other power transmission section and the rod is moved according to movement of the shaft through the other power transmission section; and a display plate which changes display according to movement of the rod is provided and the display plate indicates whether the movable electrode is in a closed state or an open state with respect to the fixed electrode.

11. The operating device according to claim 2, wherein the auxiliary contact is supported by a support plate; and an area between the capacitor and the auxiliary contact is partitioned by the support plate.

12. The operating device according to claim 3, wherein the auxiliary contact is supported by a support plate; and an area between the capacitor and the auxiliary contact is partitioned by the support plate.

13. The operating device according to claim 11, wherein a lateral surface of the capacitor is fixed to a supporting member and the supporting member is supported by the case;

a bottom plate is provided on a bottom of the case; and a space larger than distance from the bottom plate to an upper end of the supporting member is formed between the capacitor and the support plate.

14. The operating device according to claim 12, wherein a lateral surface of the capacitor is fixed to a supporting member and the supporting member is supported by the case;

a bottom plate is provided on a bottom of the case; and a space larger than distance from the bottom plate to an upper end of the supporting member is formed between the capacitor and the support plate.

15. The operating device according to claim 11, wherein a lateral surface of the capacitor is fixed to a supporting member and the supporting member is supported by the case; and a space larger than height of the capacitor is formed between an upper end of the capacitor and the support plate.

16. The operating device according to claim 12, wherein a lateral surface of the capacitor is fixed to a supporting member and the supporting member is supported by the case; and a space larger than height of the capacitor is formed between an upper end of the capacitor and the support plate.

17. A vacuum switch comprising:

the operating device according to claim 2;

a movable electrode operated through movement of the movable part;

a fixed electrode located opposite to the movable electrode;

a vacuum container housing the movable electrode and the fixed electrode; and a bus or cable connected to either the movable electrode or the fixed electrode through a conductor.

18. A vacuum switch comprising:

the operating device according to claim 3;

a movable electrode operated through movement of the movable part;

a fixed electrode located opposite to the movable electrode;

a vacuum container housing the movable electrode and the fixed electrode; and a bus or cable connected to either the movable electrode or the fixed electrode through a conductor.

19. A vacuum switch comprising:

the operating device according to claim 4;

a movable electrode operated through movement of the movable part;

a fixed electrode located opposite to the movable electrode;

a vacuum container housing the movable electrode and the fixed electrode; and a bus or cable connected to either the movable electrode or the fixed electrode through a conductor.

20. A vacuum switch comprising:

the operating device according to any claim 5;

a movable electrode operated through movement of the movable part;

a fixed electrode located opposite to the movable electrode;

a vacuum container housing the movable electrode and the fixed electrode; and a bus or cable connected to either the movable electrode or the fixed electrode through a conductor.

* * * * *